United States Patent [19]

Tsutsui et al.

[11] 4,145,263

[45] Mar. 20, 1979

[54] STEEL SHEET USEFUL IN FORMING FOODSTUFF AND BEVERAGE CANS

[75] Inventors: Nobuyuki Tsutsui, Kudamatsu; Tsuneo Inui, Tokuyama; Hiroaki Kawamura, Kudamatsu, all of Japan

[73] Assignee: Toyo Kohan Co., Ltd., Tokyo, Japan

[21] Appl. No.: 824,304

[22] Filed: Aug. 12, 1977

[30] Foreign Application Priority Data

Aug. 25, 1976 [JP] Japan ..... 51/100501

[51] Int. Cl.[2] ..... C25D 11/38; C25D 5/48

[52] U.S. Cl. ..... 204/35 R; 204/37 T; 204/56 R

[58] Field of Search ..... 204/35 R, 37 T, 42, 204/56 R

[56] References Cited

U.S. PATENT DOCUMENTS

| | | | |
|---|---|---|---|
| 3,216,912 | 11/1965 | Shoemaker | 204/37 T |
| 3,313,714 | 4/1967 | Joyce et al. | 204/35 R |
| 3,491,001 | 1/1970 | Shackleford | 204/56 R |
| 3,799,814 | 3/1974 | Yamagishi | 428/667 |

*Primary Examiner*—John H. Mack
*Assistant Examiner*—William Leader
*Attorney, Agent, or Firm*—Wenderoth, Lind & Ponack

[57] ABSTRACT

A steel sheet is provided herein which has been treated to form thereon a first very thin layer of tin and a second layer of hydrated chromium oxide. This treated steel sheet can effectively be coated with an organic coating, and can be used for producing cans for foodstuffs and carbonated beverages.

6 Claims, 4 Drawing Figures

STEEL SHEET USEFUL IN FORMING FOODSTUFF AND BEVERAGE CANS

BACKGROUND OF THE INVENTION

The present invention relates to a steel sheet having an extremely thin duplex layer thereon. The upper layer (layer farthest from the steel base) consists of hydrated chromium oxide and the lower layer (layer closest to the steel base) consists of a very thin layer of tin. The steel sheet having such duplex layer can be coated with an organic coating.

DESCRIPTION OF THE PRIOR ART

Electrotinplates have been previously used in the industry for manufacturing food cans. For some years now, however, tin-free steel (TFS) consisting of metallic chromium and hydrated chromium oxide has been largely used for manufacturing carbonated beverage cans, instead of electrotinplates.

The switch from expensive electrotinplates to cheaper TFS for use in food cans has been effected, because the tin used for the production of tinplates is very expensive and because there is concern over the exhaustion of tin resources in the world.

There are some problems involved in the use of TFS for food cans. These include formation of rust under the organic film, dissolution of iron by local corrosion in cracks developed in the organic coating, and deterioration of the flavor of foodstuffs by iron pick-up during long storage in the formed parts of TFS cans, particularly the flange in the can body and the chuck wall radius in the can ends. Therefore, TFS is not satisfactory as a material for food cans. The cracks are caused in TFS films by the light forming because the formability of TFS film is poor. Also, cracks in the paint film on the TFS film may result. In such construction, the metallic chromium layer in the TFS acts as a cathode, and the base steel acts as an anode in foodstuffs. Therefore, if the formed part of the TFS contacts with the foodstuff, a local cell is formed between the metallic chromium and base steel, and corrosion of the base steel is accelerated. Furthermore, the corrosion reaction is concentrated in the formed part of the TFS film, where the steel base is exposed through the crack in the film. The undercutting corrosion observed in black plates and tinplates does not occur in TFS because of the insolubility of metallic chromium in foodstuffs.

In TFS cans containing a carbonated beverage having a low pH, the local corrosion of the steel base proceeds to the point where perforations may occur in the steel base. With foodstuffs of a comparatively higher pH such as vegetable soup, fish and meat, rust occurs in the formed part of the cans, where the steel base is exposed.

In order to produce tinplates and TFS having excellent corrosion resistance for use in containers for acidic foodstuffs, particularly carbonated beverages, the addition of various elements to steel during steel production has been proposed (Japanese Patent Publication Nos. Sho 46-39577, Sho 48-3049, Sho 48-3050 and Sho 48-3051). This method is undesirable because of such problems as formation of scratches on the steel surface after the steel has been produced, and deterioration in the flavor of foodstuffs caused by dissolution of the elements added to the steel.

SUMMARY OF THE INVENTION

It is an object of the present invention to provide a steel sheet which has been treated to enable it to undergo organic coating, and which has excellent paint adhesion and high corrosion resistance against foodstuffs such as acidic drinks, vegetables, fish and meats after being formed into cans.

The steel sheet, after being treated according to the present invention, has a thin duplex layer, the upper layer of which is substantially uniform in thickness and consists essentially of hydrated chromium oxide containing from 0.005 to 0.05 $g/m^2$ as chromium, and the lower layer of which is substantially uniform in thickness and consists of from 0.05 to 0.60 $g/m^2$ of tin.

Throughout the specification and claims the designation "$g/m^2$" represents gram per square meter of the surface area of the top or bottom surface of the steel sheet base.

According to the present invention, it is possible to avoid the various problems associated with electrotinplates as well as those problems associated with the use of TFS in food cans, as described above.

In the steel sheet treated according to the present invention, the formation of cracks in the organic film coated on the treated steel sheet does not occur to the extent exhibited by TFS cans. This is because the formability of the very thin tin layer, which is underneath the layer of hydrated chromium oxide, is better than that of the metallic chromium layer in TFS. Furthermore, although both tin and metallic chromium show noble potential against the steel base, and tin is slightly soluble in carbonated beverages, the potential difference between tin and the steel base is smaller than that between metallic chromium and the steel base. Therefore, local corrosion of the steel base is largely prevented and surface corrosion is only slightly observed in steel sheets treated according to the present invention, as compared with TFS.

BRIEF DESCRIPTION OF THE DRAWINGS

FIG. 1 shows the state in which the lower layer 7, composed of a very thin layer of tin, and an upper layer 9, consisting essentially of hydrated chromium oxide, are formed on the steel base 5. An oil film 10 is coated on the surface of the resultant steel sheet.

FIG. 2 shows the state in which a metallic chromium layer 8, the original amount of which desirably is zero, is deposited between the hydrated chromium oxide layer 9 and the very thin tin layer 7.

FIGS. 3 and 4 show the state in which an iron-tin alloy ($FeSn_2$) 6 is formed between the thin tin layer 7 and the steel base 5 in FIGS. 1 and 2.

DESCRIPTION OF THE PREFERRED EMBODIMENTS

Figure 1:
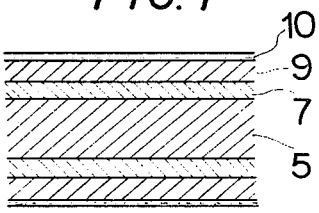
FIGS. 1, 2, 3 and 4 show magnified schematic diagrams in sections of a steel sheet treated in accordance with the present invention.
Figure 2:
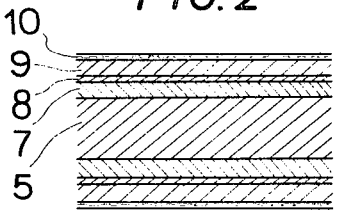
Figure 3:
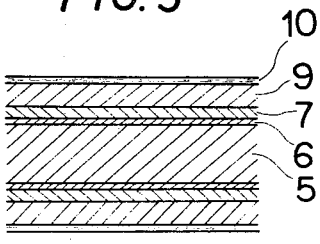
Figure 4:
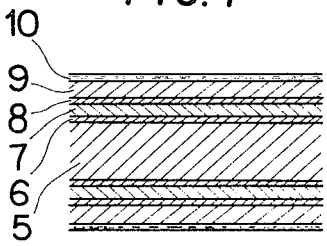

One of the features of the present invention is that it is possible to produce the inventive steel sheet very easily, without reconstructing the existing commercial electrotinning production lines.

In the case of constructing a new installation for the production of the steel sheet according to the present invention, the construction cost is relatively inexpensive because it is not necessary to use a large number of plating tanks. Furthermore, it is possible to continuously produce, on a large scale, the steel sheet at a higher speed and lower cost, since only a relatively small amount of tin is necessary.

The steel sheet treated according to the present invention, which has excellent paint adhesion and corrosion resistance after forming, can be used to manufacture cans for carbonated beverages, currently being formed from tinplates and TFS on a large scale, as well as fruit juice cans, currently being formed by using organic coated tinplate. Two-piece cans, such as oval cans, as well as drawn and redrawn cans, can also be manufactured by using the treated steel sheet of the present invention.

The steel sheet treated according to the present invention is produced by a process which comprises, as the only essential steps, electrolytically tin plating a substantially clean steel sheet and subjecting the resultant steel sheet to electrolytic chromic acid treatment to form a layer of hydrated chromium oxide on the exposed surface of tin.

From an industrial point of view, the present invention can be carried out according to the following process: degreasing with an alkali and pickling with an acid → water-rinsing → very thin electrolytic tin plating → water-rinsing → electrolytic chromic acid treatment → water-rinsing → drying → oiling, for example with dioctyl sebacate or cottonseed oil.

The steel sheet base preferably has a thickness of about 0.1–0.35 mm.

For the electrolytic tinning in the present invention, a known tinplating electrolyte such as stannous sulfate, stannous chloride and stannous fluoborate, or an alkaline electrolyte such as sodium stannate and potassium stannate may be employed.

According to the electrolytic tinplating process using the known alkaline electrolyte or the weakly acidic electolyte having a low concentration of stannous ions (described in Japanese Patent Publication No. Sho 46-25603), a considerable amount of hydrogen gas is generated. The dense tin layer thus-obtained, with the attendant formation of only a small amount of dense iron-tin alloy ($FeSn_2$), shows better corrosion resistance and paint adhesion, because the uniform iron-tin alloy layer is formed during electrolytic tinplating.

The conditions of the electrolytic tin plating are preferably as follows:

In an acidic electrolyte:

| | |
|---|---|
| Concentration of stannous ions | 1.5 – 20 g/l |
| Concentration of acid (as $H_2SO_4$) | 1.0 – 15 g/l |
| Weight ration of stannous ions to acid | 1 – 3 |
| Bath temperature | 30 – 60° C |
| Current density | 5 – 50 A/dm$^2$ |

Generally, lower current density is applied for the formation of a dense tin layer at lower bath temperature, lower concentration of stannous ions and higher concentration of acid. On the contrary, at higher bath temperature, higher concentration of stannous ions and lower concentration of acid, a higher current density is applied. Furthermore, in the case of a concentration of stannous ions and acid below 1.5 and 1.0 g/l, respectively, the electric resistance of the electrolyte increases and the current efficiency for tin plating becomes very low, and therefore, such low concentrations are not suitable for industrial production of the treated steel sheet by the present invention.

In an alkaline electrolyte:

| | |
|---|---|
| Concentration of stannic ions | 30 – 70 g/l |
| Concentration of base (as NaOH or KOH) | 10–25g/l |
| Bath temperature | 70–90° C |
| Current density | 1–10 A/dm$^2$ |

Generally in an alkaline electrolyte as compared with an acid electrolyte, a more dense tin layer is obtained but the current efficiency for tin plating is lower. Especially, the current efficiency for tin plating decreases remarkably with an increase in current density and a decrease in bath temperature.

The ranges for the conditions as described above are suitable for the industrial production of the treated steel sheet by the present invention.

The optimum range for the amount of tin is from 0.05 to 0.60 g/m$^2$. If the amount of tin is below 0.05 g/m$^2$, the corrosion resistance becomes remarkably poor. Especially, in this case, if the amount of chromium in the hydrated chromium oxide layer is also small, the corrosion resistance becomes very poor.

An increase in the amount of tin to above 0.60 g/m$^2$ is not economical because of the high price of tin, although the corrosion resistance and the paint adhesion would not be affected.

The hydrated chromium oxide layer is formed on the steel sheet, which has been covered by a very thin tin layer, according to a cathodic treatment using a known electrolyte such as a sodium dichromate solution, which is used for conventional post-treatment of an electrolytic tinplate. A chromic acid solution may also be used to which there is added a small amount of sulfuric acid, a fluorine compound, an aromatic disulfonic acid, thiourea or a combination thereof, as in the production of conventional TFS.

In the case of a cathodic treatment using a sodium dichromate solution, a quantity of electricity of about 4 to 20 times as such as that used for conventional post-treatment of an electrolytic tinplate (2–7 coulombs/dm$^2$), i.e., 8 to 140 coulombs/dm$^2$, is necessary for the formation of the hydrated chromium oxide layer required in the present invention.

The conditions for the electrolytic sodium dichromate treatment are preferably as follows:

| | |
|---|---|
| Concentration of sodium dichromate | 20 – 60 g/l |
| pH of bath (controlled by chromic acid and NaOH) | 3.5 – 7.0 |
| Bath temperature | 35 – 70° C |
| Current density | 5 – 40 A/dm$^2$ |
| Treating time | 0.1 – 10 sec. |

In the case of a cathodic treatment using a chromic acid solution, to which is added a small amount of at least one member selected from the group consisting of sulfuric acid, a fluorine compound (e.g. HF, NaF, KF, $NH_4F$, $H_2SiF_6$, $Na_2SiF_6$, $K_2SiF_6$, $(NH_4)_2SiF_6$, $HBF_4$, $NaBF_4$, $KBF_4$, $NH_4BF_4$ $NaHF_2$, $KHF_2$ and $NH_4HF_2$), an aromatic disulfonic acid (e.g. 2,4-disulfophenol, 3,5-disulfocatechol, 3,6-disulfonaphth-2-ol and 3,6-disulfo-1.8-dihydroxynaphthalene) and thiourea, the quantity of electricity of 50–150 coulombs/dm$^2$, ordinarily used in the production of conventional TFS would not be suitable herein. This is because of the formation of excess hydrated chromium oxide and the undesirable deposition of metallic chromium between the tin layer and the hydrated chromium oxide layer. Rather, in the present invention, the quantity of electricity should be limited to about 5–20 coulombs/dm$^2$.

The conditions for the electrolytic chromic acid treatment are preferably as follows:

| | |
|---|---|
| Concentration of chromic acid | 30 – 100 g/l |
| Weight ratio of chromic acid to additives, e.g. $H_2SO_4$ and a fluorine compound | 100 – 300 |
| Bath temperature | 35 – 70° C |
| Current density | 5 – 50 A/dm$^2$ |
| Treating time | 0.1 – 5 sec. |

The optimum range for the amount of hydrated chromium oxide is 0.005 to 0.05 g/m$^2$, calculated as chromium. If the amount of hydrated chromium oxide is below 0.005 g/m$^2$, the corrosion resistance becomes poor. Especially the paint adhesion after aging becomes remarkably poor because of a decrease in the inhibition effect of the hydrated chromium oxide layer towards oxidation of the tin layer.

If the amount of hydrated chromium oxide is above 0.05 g/m$^2$, the corrosion resistance and the paint adhesion deteriorate because the formability of the hydrated chromium oxide layer will be poor.

According to the cathodic treatment using the above-mentioned chromic acid solution, metallic chromium, which is deposited between the hydrated chromium oxide layer and the tin layer, does not dissolve into the foodstuff.

Too large an amount of deposited metallic chromium leads to poor formability and exhibits deleterious effects on the formability of the hydrated chromium oxide layer and organic coating.

Therefore, the amount of metallic chromium must be below 0.005 g/m$^2$ in accordance with the present invention.

After the electrolytic treatment with sodium dichromate or chromic acid; dibutyl sebacate, dioctyl sebacate or cottonseed oil is usually coated on the treated steel sheet in the same was as in electrolytic tinning, for preventing scratches during handling.

The present invention is illustrated by the following Examples.

EXAMPLE 1

A cold reduced steel sheet was electrolytically degreased in a solution of sodium hydroxide and then pickled in dilute sulfuric acid. The steel sheet, after being rinsed with water, was electroplated with tin under the following plating conditions.

| | |
|---|---|
| Composition of electrolyte: | |
| Stannous sulfate | 30 g/l |
| Phenol sulfonic acid (60 % aqueous solution) | 25 g/l |
| Ethoxylated α-naphthol sulfonic acid | 3 g/l |
| Bath temperature: | 45° C |
| Cathodic current density: | 7 A/dm$^2$ |
| Tin coating weight: | 0.09 g/m$^2$ |

After rinsing with water, the tin-coated steel sheet was cathodically treated under the following conditions and was then rinsed with water, dried and coated with a thin film of dioctyl sebacate (DOS) by the ordinary method used in the electrotinning process.

| | |
|---|---|
| Composition of electrolyte: | |
| Sodium dichromate | 30 g/l |

-continued

| | |
|---|---|
| Bath temperature: | 50° C |
| Cathodic current density: | 10 A/dm$^2$ |
| Chromium weight in hydrated chromium oxide: | 0.013 g/m$^2$ |

The characteristics of the steel sheet thus-coated with a tin layer and a hydrated chromium oxide layer were evaluated by the following testing methods, the results of which are shown in the attached Table.

(1) Paint adhesion:

The treated sample was baked at 210° C. for 12 minutes after coating with 50 mg/dm$^2$ of phenol-epoxy type paint (tradename SJ-6256 made by Kansai Paint Co., Ltd.).

The coated sample was cut into a circular blank having a diameter of 80 mm by a punch press, and the blank was deeply drawn to form a cup at a drawing ratio of 2.0. The paint film on the bottom of the cup was scratched crosswise with a razor, and an attempt was made to peel the paint film from the side and the scratched bottom of the cup with an adhesive tape.

(2) Corrosion resistance against an acidic solution after forming:

The sample coated and baked as described in (1) above was cut to a size of 15 mm × 100 mm. The test piece was bent to 180° C. by the drop of a 3 kg weight from a height of 150 mm after placing a steel sheet having a thickness of 0.28 mm between the pre-bent test piece. The bent test piece was sealed by an adhesive tape made with polyvinyl chloride film, except for the formed part, and was put in 300 ml of a 0.01 mole/l phosphoric acid solution, at room temperature for one week. The same procedure was repeated for another test piece, except using a 0.01 mole/l citric acid solution containing 0.3% by weight of sodium chloride. Iron pick-up in each solution was measured and the change in the surface appearance of each test piece was evaluated with the naked eye.

(3) Sulfide staining:

A cup as used for the paint adhesion test was immersed in a 10 g/l sodium sulfide solution maintained at pH 3.5 by lactic acid, at 90° C. for one hour. The proportion of discoloration through the paint film on the deeply drawn portion of the cup was evaluated with the naked eye.

EXAMPLE 2

A steel sheet pre-treated as in Example 1 was plated with tin under the following plating conditions. After water-rinsing, the tin coated steel sheet was subjected to an electrolytic chromic acid treatment under the following conditions, after which DOS was coated thereon in the same manner as mentioned in Example 1.

| | |
|---|---|
| Conditions of Electrotinplating | |
| Composition of electrolyte: | |
| Stannous sulfate | 5 g/l |
| Phenol sulfonic acid (60 % aqueous solution) | 4 g/l |
| Ethoxylated α-naphthol sulfonic acid | 0.5 g/l |
| Bath temperature: | 45° C |
| Cathodic current density: | 10 A/dm$^2$ |
| Tin coating weight: | 0.30 g/m$^2$ |
| Conditions of electrolytic chromic acid treatment | |
| Composition of electrolyte: | |
| Chromic acid | 80 g/l |
| Sulfuric acid | 0.4 g/l |
| Fluoboric acid | 0.2 g/l |

-continued

| | |
|---|---|
| Bath temperature: | 50° C |
| Cathodic current density: | 15 A/dm$^2$ |
| Metallic chromium weight: | 0.003 g/m$^2$ |
| Chromium weight in hydrated chromium oxide: | 0.045 g/m$^2$ |

The characteristics of the thus-treated steel sheet were evaluated by the test methods described in Example 1, the results of which are shown in the Table.

EXAMPLE 3

A steel sheet pre-treated as in Example 1 was plated with tin under the following plating conditions. After water-rinsing, the tin coated steel sheet was subjected to a cathodic treatment in 30 g/l of sodium dichromate under 5 A/dm$^2$ at a bath temperature of 50° C.

The characteristics of the steel sheet, having 0.005 g/m$^2$ as chromium in the thus-formed hydrated chromium oxide layer, were evaluated by the test methods described in Example 1. The results are shown in the Table.

| Conditions of electrotinplating | |
|---|---|
| Composition of electrolyte: | |
| Sodium stannate | 80 g/l |
| Sodium hydroxide | 15 g/l |
| Bath temperature: | 80° C |
| Cathodic current density: | 2 A/dm$^2$ |
| Tin coating weight: | 0.22 g/m$^2$ |

EXAMPLE 4

A steel sheet pre-treated as in Example 1 was plated with tin under the following conditions. After water-rinsing, the tin coated steel sheet was subjected to electrolytic chromic acid treatment under the following conditions, and was coated on the thus-treated steel sheet in the same manner as mentioned in Example 1.

| Conditions of electrotinplating | |
|---|---|
| Composition of electrolyte: | |
| Sodium stannate | 80 g/l |
| Sodium hydroxide | 15 g/l |
| Bath temperature: | 80° C |
| Cathodic current density: | 3 A/dm$^2$ |
| Tin coating weight: | 0.55 g/m$^2$ |
| Conditions of electrolytic chromic acid treatment | |
| Composition of electrolyte: | |
| Chromic acid | 60 g/l |
| Sulfuric acid | 0.3 g/l |
| Bath temperature: | 55° C |
| Cathodic current density: | 20 A/dm$^2$ |
| Metallic chromium weight: | 0.004 g/m$^2$ |
| Chromium weight in hydrated chromium oxide: | 0.018 g/m$^2$ |

The characteristics of the thus-treated steel sheet were evaluated by the test methods described in Example 1, and the results are shown in the Table.

COMPARATIVE EXAMPLE 1

A steel sheet pre-treated as in Example 1 was plated with tin under the following plating conditions, after which the tin coated steel sheet was flow-melted by using ordinary resistance heating as in the electrotinning process, and then was subjected to cathodic treatment in 30 g/l of sodium dichromate under 3 A/dm$^2$ at a bath temperature of 50° C.

The characteristics of the resultant electrotinplate, having 0.004 g/m$^2$ as chromium in the hydrated chromium oxide layer, were evaluated by the test methods described in Example 1. The results are shown in the Table.

| Conditions of electrotinplating | |
|---|---|
| Composition of electrolyte: | |
| Stannous sulfate | 60 g/l |
| Phenol sulfonic acid (60 % aqueous solution) | 50 g/l |
| Ethoxylated α-naphthol sulfonic acid | 6 g/l |
| Bath temperature: | 45° C |
| Cathodic current density: | 8 A/dm$^2$ |
| Total tin coating weight: | 5.58 g/m$^2$ |
| Tin weight in iron-tin alloy ($FeSn_2$) | 0.49 g/m$^2$ |

COMPARATIVE EXAMPLE 2

A steel sheet pre-treated as in Example 1 was subjected to electrolytic chromic acid treatment under the following conditions. After rinsing with water and drying, DOS was coated thereon by the same method as described in Example 1.

| Conditions of electrolytic chromic acid treatment | |
|---|---|
| Composition of electrolyte: | |
| Chromic acid | 80 g/l |
| Sulfuric acid | 0.4 g/l |
| Fluoric acid | 0.2 g/l |
| Bath temperature: | 55° C |
| Cathodic current density: | 40 A/dm$^2$ |
| Metallic chromium weight: | 0.11 g/m$^2$ |
| Chromium weight in hydrated chromium oxide: | 0.023 g/m$^2$ |

The characteristics of the resultant TFS were evaluated by the test methods described in Example 1, the results of which are shown in the Table.

As apparent from the Table, the treated steel sheet of the present invention has excellent paint adhesion, corrosion resistance to acids after forming, and sulfide stain resistance. This treated steel sheet is therefore quite suitable for use as a material for making food cans, a field in which electrotinplate and TFS are widely used.

TABLE

Characteristics of Treated Steel Sheets

| | | | Example 1 | Example 2 |
|---|---|---|---|---|
| | Tinplating bath | | Phenol sulfonic acid bath | Phenol sulfonic acid bath |
| * | Tin coating weight in g/m$^2$ | | 0.09 | 0.30 |
| | Amount of hydrated Cr oxide (as Cr) in g/m$^2$ | | 0.013 | 0.045 |
| ** | Amount of metallic chromium in g/m$^2$ | | 0 | 0.003 |
| | Paint adhesion | | No adhesion loss on bottom or side of drawn cup | No adhesion loss on bottom or side of drawn cup |
| | 0.01 mole/l $H_3PO_4$ | Appearance | Slight surface corrosion | Slight surface corrosion |
| | | Dissolved Fe in ppm | 0.29 | 0.18 |
| *** | 0.01 mole/l citric acid | Appearance | Slight pitting | Slight pitting |
| | | Dissolved Fe in ppm | 0.30 | 0.26 |
| | Sulfide staining | | No blackening | No blackening |
| | Total evaluation | | Good | Good |

TABLE-continued

| Example 3 | Example 4 | Comparative Example 1 (tinplate) | Comparative Example 2 (TFS) |
|---|---|---|---|
| $Na_2SnO_3$ bath | $Na_2SnO_3$ bath | Phenol sulfonic acid bath | — |
| 0.22 | 0.55 | 5.58 | — |
| 0.005 | 0.018 | 0.004 | 0.023 |
| 0 | 0.004 | 0 | 0.11 |
| No adhesion loss on bottom or side of drawn cup | No adhesion loss on bottom or side of drawn cup | Paint is peeled off on bottom; no adhesion loss on side of drawn cup | No adhesion loss on bottom or side of drawn cup |
| Slight surface corrosion | Slight surface corrosion | Slight surface corrosion | Substantial pitting |
| 0.24 | 0.20 | 0.20 | 0.83 |
| Slight pitting | Slight pitting | Slight pitting | Substantial pitting |
| 0.44 | 0.17 | 0.31 | 1.06 |
| Slight blackening | Slight blackening | More than slight blackening | No blackening |
| Good | Good | Poor | Fair |

*: Tin plating
**: Electrolytic chromic acid treatment
***: Corrosion resistance after forming

What is claimed is:

1. A process for producing a steel sheet containing a first layer of tin and a second layer of hydrated chromium oxide, which consists essentially of electrolytically tin plating a substantially clean steel sheet base in an electrolyte containing stannous sulfate, stannous chloride, stannous fluoborate, sodium stannate or potassium stannate, to obtain a tin plated steel sheet in which the amount of plated tin is 0.05–0.60 g/m$^2$, subjecting the resultant steel sheet to an electrolytic treatment at 5–20 coulombs/dm$^2$ under 5–50 A/dm$^2$ of current density in an electrolyte containing chromic acid and at least one member selected from the group consisting of sulfuric acid, a fluorine compound, an aromatic disulfonic acid and thiourea, to form a second layer consisting essentially of hydrated chromium oxide in an amount of 0.005 to 0.05 g/m$^2$ calculated as chromium, any metallic chromium deposited between said first and second layers being present in an amount less than 0.005 g/m$^2$.

2. A process for producing a steel sheet according to claim 1, wherein the electrolytic tin plating step is performed in an acidic electrolyte at a current density of 5–50 A/dm$^2$.

3. A process for producing a steel sheet according to claim 1, wherein the electrolytic tin plating step is performed by use of an alkaline electrolyte at a current density of 1–10 A/dm$^2$.

4. A process for producing a steel sheet containing a first layer of tin and a second layer of hydrated chromium oxide, which consists essentially of electrolytically tin plating a substantially clean steel sheet base in an electrolyte containing stannous sulfate, stannous chloride, stannous fluoborate, sodium stannate or potassium stannate, to obtain a tin plated steel sheet in which the amount of plated tin is 0.05–0.60 g/m$^2$, and subjecting the resultant steel sheet to an electrolytic treatment at 8–140 coulombs/dm$^2$ under 5–40 A/dm$^2$ of current density in an electrolyte containing sodium dichromate, to form a second layer consisting of hydrated chromium oxide in an amount of 0.005 to 0.05 g/m$^2$ calculated as chromium, any metallic chromium deposited between said first and second layers being present in an amount less than 0.005 g/m$^2$.

5. A process for producing a steel sheet according to claim 4, wherein the electrolytic tin plating step is performed in an acidic electrolyte at a current density of 5–50 A/dm$^2$.

6. A process for producing a steel sheet according to claim 4, wherein the electrolytic tin plating step is performed in an alkaline electrolyte at a current density of 1–10 A/dm$^2$.

* * * * *